US009054437B2

(12) United States Patent
Kojima et al.

(10) Patent No.: US 9,054,437 B2
(45) Date of Patent: Jun. 9, 2015

(54) TERMINAL FITTING

(71) Applicant: Yazaki Corporation, Tokyo (JP)

(72) Inventors: Hiroshi Kojima, Makinohara (JP); Tsutomu Sawada, Makinohara (JP)

(73) Assignee: Yazaki Corporation, Tokyo (JP)

( * ) Notice: Subject to any disclaimer, the term of this patent is extended or adjusted under 35 U.S.C. 154(b) by 15 days.

(21) Appl. No.: 14/090,155

(22) Filed: Nov. 26, 2013

(65) Prior Publication Data

US 2014/0087607 A1 Mar. 27, 2014

Related U.S. Application Data

(63) Continuation-in-part of application No. PCT/JP2012/062986, filed on May 22, 2012.

(30) Foreign Application Priority Data

Jun. 2, 2011 (JP) ..... 2011-124046

(51) Int. Cl.

| | |
|---|---|
| ***H01R 13/434*** | (2006.01) |
| ***H01R 13/04*** | (2006.01) |
| *H01R 13/193* | (2006.01) |
| *H01R 13/44* | (2006.01) |

(52) U.S. Cl.

CPC ..... *H01R 13/04* (2013.01); *H01R 2201/26* (2013.01); *H01R 13/193* (2013.01); *H01R 13/44* (2013.01)

(58) Field of Classification Search

CPC ..... H01R 13/434; H01R 13/41

USPC ..... 439/745, 733.1, 871, 872, 873, 891, 439/937

See application file for complete search history.

(56) References Cited

U.S. PATENT DOCUMENTS 4,438,995 A 3/1984 Fisher et al.
5,904,599 A * 5/1999 Miller et al. ..... 439/827

(Continued)

FOREIGN PATENT DOCUMENTS

EP 0951099 A2 10/1999
GB 2308753 A 7/1997

(Continued)

OTHER PUBLICATIONS

Supplementary European Search Report dated Oct. 10, 2014, issued for the corresponding European patent application No. 12793558.3.

(Continued)

*Primary Examiner* — Phuongchi T Nguyen
(74) *Attorney, Agent, or Firm* — Locke Lord LLP

(57) ABSTRACT

Provided is a terminal fitting capable of making an electric contact portion and a cap member retained at the electric contact portion to be reliably engaged together. A terminal fitting includes an electric contact portion provided at one end side and formed into a tube-like shape such that a mating terminal is fitted thereto, an electric wire connection portion provided at the other end side and arranged to fasten an electric wire, and a cap member fitted to a distal end of the electric contact portion and retained at the distal end. A first engagement portion arranged to engage with the cap member is provided at the distal end of the electric contact portion, and the cap member is provided with a second engagement portion arranged to engage with the first engagement portion.

1 Claim, 5 Drawing Sheets

(56) References Cited

U.S. PATENT DOCUMENTS

| | | | | |
|---|---|---|---|---|
| 6,113,436 | A | 9/2000 | Kuwahara et al. | |
| 6,146,211 | A | 11/2000 | Okamoto et al. | |
| 6,149,472 | A | 11/2000 | Endo et al. | |
| 2002/0064986 | A1 * | 5/2002 | Hirai et al. | 439/181 |

FOREIGN PATENT DOCUMENTS

| | | | |
|---|---|---|---|
| JP | 62-198064 | A | 9/1987 |
| JP | 2000003750 | A | 1/2000 |
| JP | 2000-091014 | A | 3/2000 |
| JP | 2000-150040 | A | 5/2000 |
| JP | 2003-178830 | A | 6/2003 |
| JP | 2006-339167 | A | 12/2006 |
| WO | WO-87/05157 | A1 | 8/1987 |
| WO | WO-2011/030712 | A1 | 3/2011 |

OTHER PUBLICATIONS

International Search Report dated Jul. 10, 2012, issued for PCT/JP2012/062986.

* cited by examiner

TERMINAL FITTING

TECHNICAL FIELD

The present invention relates to a terminal fitting capable of making an electric contact portion and a cap member retained at the electric contact portion to be reliably engaged together.

BACKGROUND ART

For example, a vehicle is mounted with various electronic devices and electric components. A wire harness is used for transmitting power from a power source, such as a battery, and a control signal from a control device and such to these electronic devices and the electric components.

The wire harness includes an end provided with a connector for connection with the electronic device or the electric component. The wire harness is formed of a plurality of electric wires bundled together, and an end of the electric wires is connected to a terminal fitting housed in said connector.

The terminal fitting is formed by blanking and shaping the metal plate, and thus an edge of the terminal fitting is sharply pointed. Thus, when the terminal fitting is inserted into the connector and housed in the connector, it is possible that an inner side of the connector is cut and damaged by the edge of the terminal fitting.

Given this problem, a terminal fitting preventing damage to an inner side of a connector has been proposed (for example, refer to Patent Literature 1). As shown in FIG. 6 and FIG. 7, a terminal fitting 101 shown in Patent Literature 1 includes an electric contact portion 106 formed into a tube-like shape so that a mating terminal is fitted thereto, an electric wire connection portion 109 to which an electric wire is connected by crimping, and a cap member 103 inserted into the electric contact portion 106 and provided at a distal end of the electric contact portion 106.

CITATION LIST

Patent Literature

Patent Literature 1: Japan Patent Application Publication No. 2000-91014

SUMMARY OF INVENTION

Problem to be Solved

However, there is a problem in the conventional terminal fitting 101 disclosed in Patent Literature 1. That is, recently the cap member 103 has been downsized with downsizing of the terminal fitting, and this is causing a decrease in engagement force between the electric contact portion 106 and the cap member 103. Thus, to prevent the cap member 103 from being falling off, it is necessary to apply an adhesive agent on a shaft portion 103*a* of the cap member 103 to retain the cap member 103 at the electric contact portion 106 by adhesive force of the adhesive agent.

Consequently, it is necessary to apply the adhesive agent when attaching the cap member 103 to the terminal fitting 101, causing an increase in burden on workers.

Furthermore, there is a problem that there may be variation in retaining force for retaining the cap member 103 to the terminal fitting 101 caused by difference in level of skill of the workers applying the adhesive agent.

Moreover, there is a problem that the cost is increased due to the use of the expendable adhesive agent.

The present invention aims to solve the above-mentioned problem. Thus, an object of the present invention is to provide a terminal fitting capable of making an electric contact portion and a cap member retained at the electric contact portion to be reliably engaged together.

Solution to Problem

In order to achieve the above-described object, the present invention provides, in a first aspect, a terminal fitting including: an electric contact portion provided at one end and formed into a tube-like shape such that a mating terminal is fitted thereto; an electric wire connection portion provided at the other end and arranged to fasten an electric wire; and a cap member fitted to a distal end of the electric contact portion and retained at the distal end, wherein a first engagement portion arranged to engage with the cap member is provided at the distal end of the electric contact portion, and wherein the cap member is provided with a second engagement portion arranged to engage with the first engagement portion.

In order to achieve the above-described object, the present invention provides, in a second aspect, the terminal fitting described above, wherein the first engagement portion is formed into a hook-like shape and provided with a projecting portion projecting from an edge of the distal end of the electric contact portion in a longitudinal direction of the electric contact portion, and a standing portion extending from a distal end of the projecting portion in a direction substantially perpendicular to a projecting direction of the projecting portion, and wherein the second engagement portion is formed into a hook-like shape and provided with a standing piece extending from one end of the cap member in a direction substantially parallel to an extending direction of the standing portion and arranged to engage with the standing portion, and a bulge portion bulged from the standing piece in the longitudinal direction of the electric contact portion and arranged to engage with an inner circumferential face of the electric contact portion.

Advantageous Effects of Invention

According to the invention described in the first aspect, the terminal fitting is arranged such that the first engagement portion provided at the distal end of the electric contact portion is engaged with the second engagement portion provided at the cap member. Thus, the cap member can be reliably retained at the electric contact portion without using an adhesive means such as adhesive agent.

Consequently, there is no need to apply the adhesive agent when attaching the cap member to the terminal fitting, thereby reducing burden on workers.

Furthermore, since there is no need to apply the adhesive agent to the cap member, the cap member can be reliably retained at the terminal fitting without being influenced by workers' level of skill.

Moreover, the expendable adhesive agent is no longer required, thereby reducing the cost.

As described above, according to the invention described in the second aspect, the terminal fitting is arranged such that the first engagement portion of the electric contact portion is formed into the hook-like shape and the second engagement portion of the cap member is formed into the hook-like shape. Consequently, the engagement force between the first engagement portion and the second engagement portion is further increased. Thus, the cap member can be retained at the terminal fitting even more reliably.

Furthermore, the terminal fitting is arranged such that the cap member is fitted along the direction perpendicular to the longitudinal direction of the electric contact portion. Thus, the cap member can be reliably prevented from being pulled out in the longitudinal direction of the electric contact portion.

DESCRIPTION OF EXEMPLARY EMBODIMENT

Figure 1:
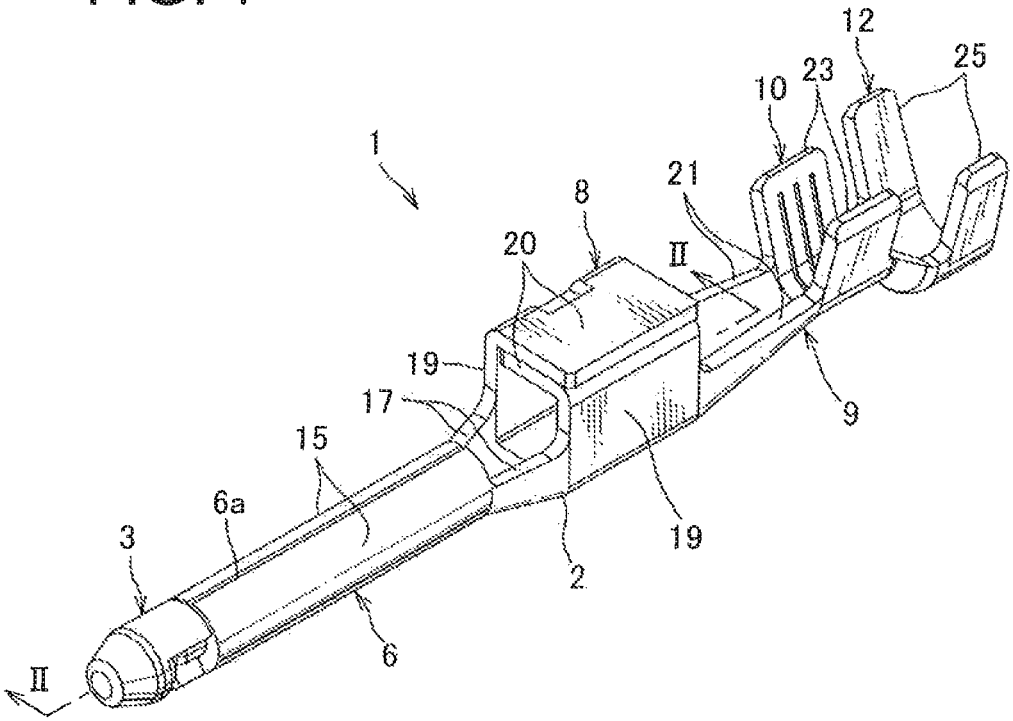
FIG. 1 illustrates a configuration of a terminal fitting according to one embodiment of the present invention.

In the following, an embodiment of the present invention is explained in reference to FIGS. 1 through 5. As shown in FIG. 1, a terminal fitting 1 according to one embodiment of the present invention includes an electric contact portion 6 provided at one end side of the terminal fitting 1 and arranged to be fitted to a mating terminal and electrically-connected to the mating terminal, an engagement portion 8 provided at a central portion of the terminal fitting 1 and arranged to be engaged with an engagement lance 76 when housed in a connector 61 (shown in FIG. 5), and an electric wire connection portion 9 provided at the other end side of the terminal fitting 1 and arranged to be electrically-connected with an electric wire by fastening the electric wire. The terminal fitting 1 includes a body portion 2 made by pressing and bending a metal plate made of copper or copper alloy or aluminum or aluminum copper.

The electric contact portion 6 includes a pair of peripheral wall portions 15, 15 and is formed into a circular tube-like shape by bending the pair of peripheral wall portions 15, 15. The electric contact portion 6 includes a slit 6*a*, a first engagement portion 28 and a cap member 3.

The slit 6*a* is provided along a longitudinal direction of the electric contact portion 6 over an entire length of the electric contact portion 6. The slit 6*a* is formed by respective edges of the pair of peripheral wall portions 15, 15 which are facing each other with a space between each other.

Figure 2:
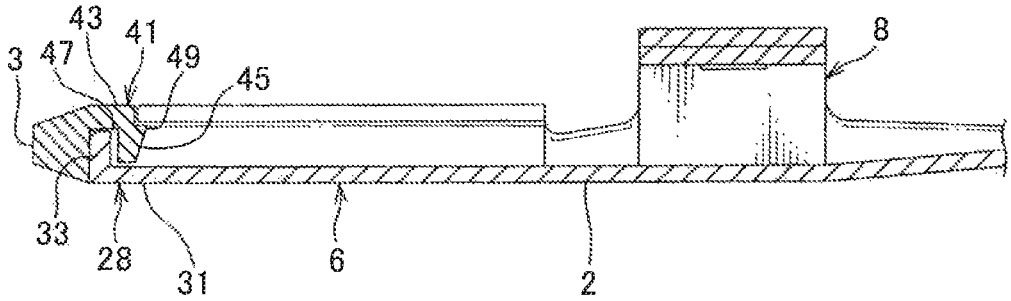
FIG. 2 is a cross-sectional view taken along a line II-II of the terminal fitting shown in FIG. 1.
Figure 4A:
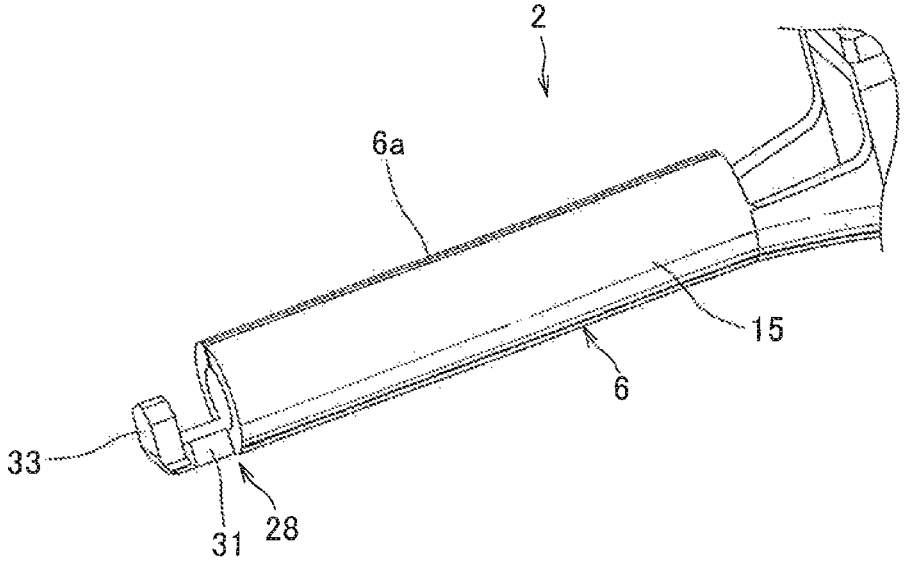
FIG. 4A is a perspective view of an electric contact portion of the terminal fitting shown in FIG. 1 and showing a front side of the electric contact portion.
Figure 4B:
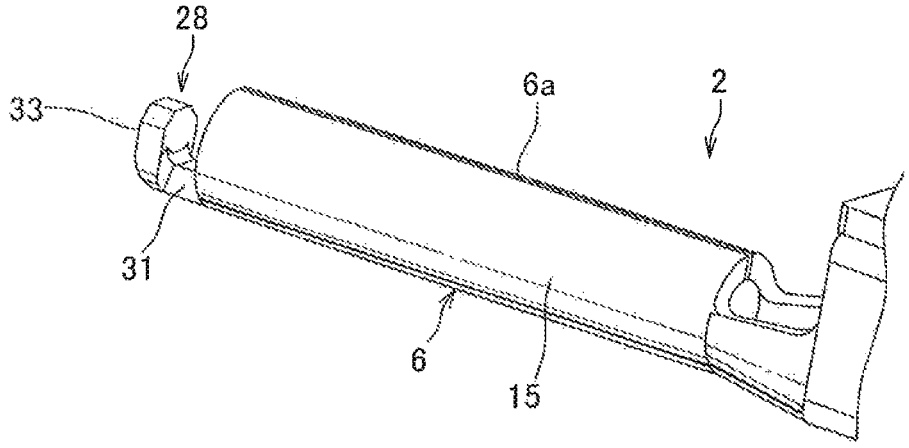
FIG. 4B is a perspective view of the electric contact portion of the terminal fitting shown in FIG. 1 and showing a back side of the electric contact portion.

The first engagement portion 28 is provided at a distal end of the electric contact portion 6, as shown in FIG. 2 and FIG. 4. The first engagement portion 28 is formed into a hook-like shape and is provided with a projecting portion 31 projecting from an edge of the distal end of the electric contact portion 6 and a standing portion 33 extending from a distal end of the projecting portion 31.

The projecting portion 31 is projecting from the edge of the distal end portion of the electric contact portion 6 in the longitudinal direction of the electric contact portion 6. The projecting portion 31 is located on an outer circumference of the electric contact portion 6 on an opposite side of the slit 6*a*.

The standing portion 33 is formed by bending the projecting portion 31. The standing portion 33 is extending from the distal end of the projecting portion 31 and extending in a direction perpendicular to the longitudinal direction of the electric contact portion 6. The standing portion 33 is extending to the vicinity of an extension of an inner circumferential face of the electric contact portion 6 on the side of the slit 6*a*. The distal end of the standing portion 33 is chamfered and thus corners thereof are obliquely-cut off. A space is provided between the standing portion 33 and the edge of the distal end of the electric contact portion 6 on the side of the slit 6*a*, for engagement with a later-described second engagement portion 41 of the cap member 3.

Figure 3A:
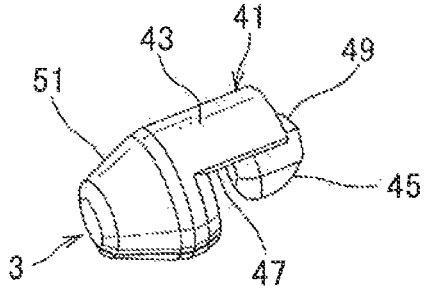
FIG. 3A is a perspective view illustrating a configuration of a cap member of the terminal fitting shown in FIG. 1 and showing a distal end side of the cap member.
Figure 3B:
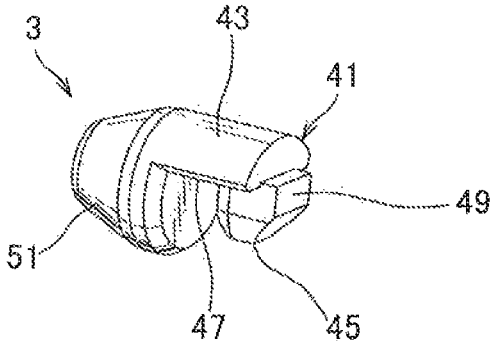
FIG. 3B is a perspective view illustrating a configuration of the cap member of the terminal fitting shown in FIG. 1 and showing a back end side of the cap member.

The cap member 3 is made of flexible synthetic resin such as polyvinyl chloride resin and polypropylene resin. As shown in FIG. 2 and FIG. 3, the cap member 3 includes a tapered portion 51 formed into a tapered shape and a second engagement portion 41 arranged to be engaged with the first engagement portion 28 of the electric contact portion 6.

The tapered portion 51 has a large diameter portion formed into substantially the same diameter as the outer diameter of an outer circumferential face of the electric contact portion 6, and the diameter of the tapered portion 51 is gradually decreased as extending toward its distal end. A diameter of a small diameter portion of the tapered portion 51 located at the distal end is about one-half of the diameter of the large diameter portion.

The second engagement portion 41 includes a standing piece 45 extending from an extended portion 43, and a bulge portion 49 provided at the standing piece 45. The second engagement portion 41 is provided at the extended portion 43 extending from an edge of the large diameter portion of the tapered portion 51 along the longitudinal direction of the electric contact portion 6. The second engagement portion 41 is loaned into a hook-like shape.

The extended portion 43 is provided on an extension of the slit 6*a* of the electric contact portion 6 in the longitudinal direction. The extended portion 43 is formed into an arc-like shape following the shape of the large diameter portion of the tapered portion 51.

The standing piece 45 is extending in a direction perpendicular to the longitudinal direction of the electric contact portion 6. The standing piece 45 is extending to the vicinity of the inner circumferential face of the electric contact portion 6 on the side of the projecting portion 31 of the first engagement portion 28. The standing piece 45 is formed narrower than the extended portion 43. The standing piece 45 is arranged to be engaged with the standing portion 33 of the first engagement portion 28 of the electric contact portion 6. The standing piece 45 and the large diameter portion of the tapered portion 51 together form a groove portion 47 in which the standing portion 33 is housed. The cap member 3 is inserted and fitted in the direction perpendicular to the longitudinal direction of the electric contact portion 6, thus the cap member 3 is reliably prevented from being pulled out in the longitudinal direction of the electric contact portion 6.

The bulge portion 49 is bulged from a proximal end of the standing piece 45 in the longitudinal direction of the electric contact portion 6, and the size of the bulge is gradually increased from the distal end toward the proximal end of the standing piece 45. The bulge portion 49 is bulged out more than a distal end of the extended portion 43. Thus, the bulge portion 49 engages with the inner circumferential face of the electric contact portion 6 on the side of the slit 6*a*.

As shown in FIG. 1, the engagement portion 8 is formed into a rectangular tube-like shape and includes the body portion 2, a pair of side walls 19, 19 extending from the body portion 2, and a pair of upper faces 20, 20 extending from the pair of side walls 19, 19 and overlapped each other. The engagement portion 8 and the electric contact portion 6 are integrally formed via the body portion 2 and a pair of side walls 17, 17 extending from the body portion 2.

The electric wire connection portion 9 includes a core wire fastening portion 10 arranged to fasten in a crimp fashion a core wire of the electric wire, and a cover fastening portion 12 arranged to fasten in a crimp fashion a cover of the electric wire. The electric wire connection portion 9 and the engagement portion 8 are integrally formed via the body portion 2 and a pair of side walls 21, 21 extending from the body portion 2.

The core wire fastening portion 10 includes a pair of core wire fastening pieces 23, 23 extending from the body portion 2. The pair of core wire fastening pieces 23, 23 is provided with a plurality of (three, in the shown example) protrusions extending along an extending direction of the pair of core wire fastening pieces 23, 23. Thus, when the core wire of the electric wire is fastened, the protrusions bite a surface of the core wire, thereby fixing the core wire at the pair of fastening pieces 23, 23.

The cover fastening portion 12 includes a pair of cover fastening pieces 25, 25 extending from the body portion 2. The pair of cover fastening pieces 25, 25 is located lower than the pair of core wire fastening pieces 23, 23. Thus, when the core wire is fastened by the pair of core wire fastening pieces 23, 23, the pair of cover fastening pieces 25, 25 is arranged coaxially.

Figure 5:
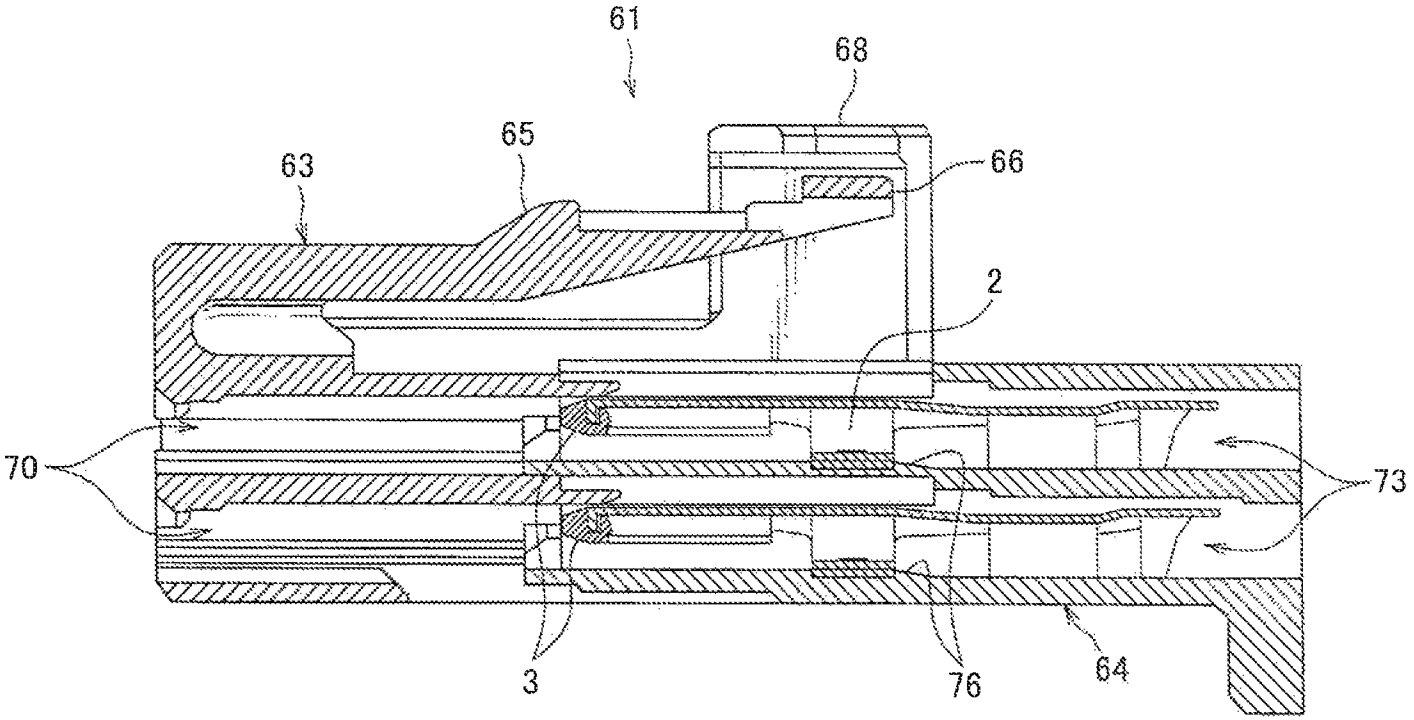
FIG. 5 is a cross-sectional view illustrating a configuration of a connector having the terminal fitting of the present invention.
Figure 6:
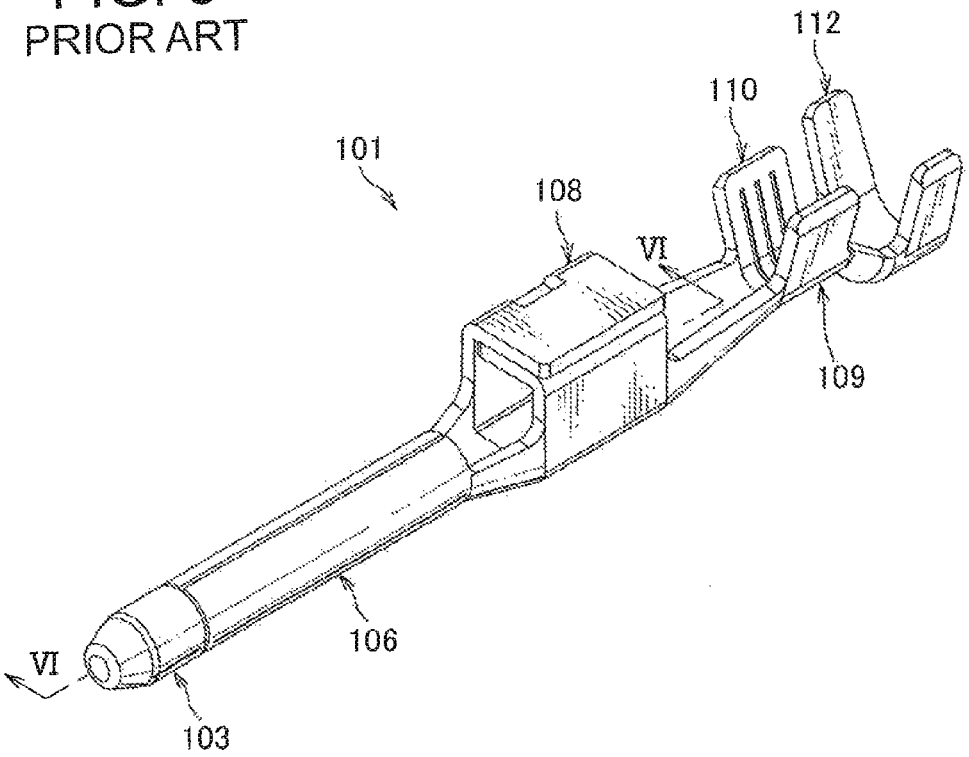
FIG. 6 PRIOR ART
FIG. 6 illustrates a configuration of a conventional terminal fitting.
Figure 7:
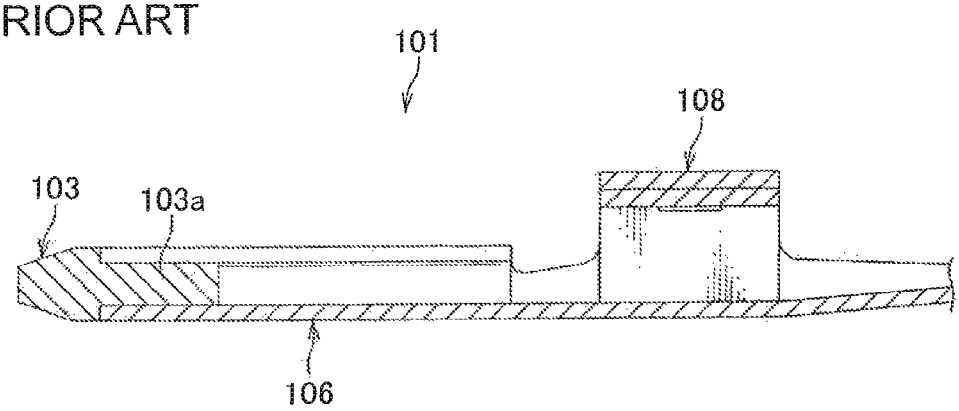
FIG. 7 PRIOR ART
FIG. 7 illustrates a cross-sectional view taken along a line VI-VI of the conventional terminal fitting shown in FIG. 6.

As exemplary shown in FIG. 5, the terminal fitting 1 arranged as described above is housed in the connector 61. The connector 61 includes an inner housing 64 in which the terminal fitting 1 is housed and an outer housing 63 to which the inner housing 64 is fitted and housed.

The inner housing 64 is provided with terminal fitting housing portions 73, 73 into which the terminal fitting 1 is inserted and fixed. Each of the terminal fitting housing portions 73, 73 includes an engagement lance 76 arranged to be engaged with the engagement portion 8 of the terminal fitting 1.

The outer housing 63 includes a connector lock portion 65 arranged to be fitted to a fitting portion of a mating connector, a lock release lever portion 66 capable of releasing the fitted state of the connector lock portion 65 and said fitting portion by bending the connector lock portion 65, a cover portion 68 preventing improper operation of the lock release lever portion 66, and through holes 70, 70 in which a mating terminal of the mating connector is inserted and which are communicating with the terminal fittings 1, 1 fixed to the inner housing 64.

To fix the terminal fitting 1 to the connector 61 described above, the terminal fitting 1 is inserted into each of the terminal fitting housing portions 73, 73 of the inner housing 64, and the terminal fitting 1 is pushed until the engagement lance 76 and the engagement portion 8 are engaged to each other. At this time, since the cap member 3 is provided at the distal end of the electric contact portion 6 of the terminal fitting 1, an inner side of the terminal fitting housing portion 73 can be prevented from being damaged.

As described above, according to this embodiment, the terminal fitting 1 includes the electric contact portion 6 provided at the one end and formed into the tube-like shape such that the mating terminal is fitted thereto, the electric wire connection portion 9 provided at the other end and arranged to fasten the electric wire, and the cap member 3 fitted to the distal end of the electric contact portion 6 and retained at the distal end. The distal end of the electric contact portion 6 is provided with the first engagement portion 28 arranged to engage with the cap member 3, and the cap member 3 is provided with the second engagement portion 41 arranged to engage with the first engagement portion 28.

Thus, for the terminal fitting 1, the first engagement portion 28 provided at the distal end of the electric contact portion 6 is engaged with the second engagement portion 41 provided at the cap member 3. Thus, the cap member 3 can be reliably retained at the electric contact portion 6 without using an adhesive means such as adhesive agent.

Consequently, there is no need to apply the adhesive agent when attaching the cap member 3 to the terminal fitting 1, thereby reducing burden on workers.

Furthermore, since there is no need to apply the adhesive agent to the cap member 3, the cap member 3 can be reliably retained at the terminal fitting 1 without being influenced by workers' level of skill.

Moreover, the expendable adhesive is no longer required, thereby reducing the cost.

Moreover, according to this embodiment, the terminal fitting 1 is arranged such that the first engagement portion 28 is formed into a hook-like shape and provided with: the projecting portion 31 projecting from the edge of the distal end of the electric contact portion 6 in the longitudinal direction of the electric contact portion 6; and the standing portion 33 extending from the distal end of the projecting portion 31 in the direction substantially perpendicular to the projecting direction of the projecting portion 31. Also, the second engagement portion 41 is formed into a hook-like shape and provided with: the standing piece 45 extending from one end of the cap member 3 in the direction substantially parallel to the extending direction of the standing portion 33 and arranged to engage with the standing portion 33; and the bulge portion 49 bulged from the standing piece 45 in the longitudinal direction of the electric contact portion 6 and arranged to engage with the inner circumferential face of the electric contact portion 6.

Thus, in the terminal fitting 1, since the first engagement portion of the electric contact portion is formed into the hook-like shape and the second engagement portion of the cap member is formed into the hook-like shape, the engagement force between the first engagement portion and the second engagement portion is further increased. Consequently, the cap member can be retained at the terminal fitting even more reliably.

Furthermore, in the conventional terminal fitting, the cap member 3 is fitted along the longitudinal direction of the electric contact portion 6. In contrast, in the terminal fitting 1 of the present invention, the cap member 3 is fitted along the direction perpendicular to the longitudinal direction of the electric contact portion 6. Thus, the cap member 3 is reliably prevented from being pulled out in the longitudinal direction of the electric contact portion 6.

The embodiments described herein are only representative embodiment of the present invention, and the present invention is not limited to these. That is, the present invention can be modified in various ways and implemented without departing from the gist of the present invention.

INDUSTRIAL APPLICABILITY

The terminal fitting according to the present invention can be used by housing it in a connector provided at a terminal of a wiring harness, the terminal fitting having one end fitted with and electrically-connected with a terminal of a mating connector, a central portion engaged with an engagement lance in the connector, and the other end to which an electric wire of the wire harness is fastened and electrically-connected.

REFERENCE SIGN LIST

1 terminal fitting
3 cap member
6 electric contact portion
8 engagement portion
9 electric wire connection portion
28 first engagement portion
31 projecting portion
33 standing portion
41 second engagement portion
43 extended portion
45 standing piece
49 bulge portion
61 connector

The invention claimed is:

1. A terminal fitting comprising:

an electric contact portion provided at one end and formed into a tube-like shape such that a mating terminal is fitted thereto;

an electric wire connection portion provided at the other end and arranged to fasten an electric wire; and a cap member fitted to a distal end of the electric contact portion and retained at the distal end, wherein a first engagement portion arranged to engage with the cap member is provided at the distal end of the electric contact portion, wherein the cap member is provided with a second engagement portion arranged to engage with the first engagement portion, wherein the first engagement portion is formed into a hook-like shape and provided with a projecting portion projecting from an edge of the distal end of the electric contact portion in a longitudinal direction of the electric contact portion, and a standing portion extending from a distal end of the projecting portion in a direction substantially perpendicular to a projecting direction of the projecting portion, and wherein the second engagement portion is formed into a hook-like shape and provided with a standing piece extending from one end of the cap member in a direction substantially parallel to an extending direction of the standing portion and arranged to engage with the standing portion, and a bulge portion bulged from the standing piece in the longitudinal direction of the electric contact portion and arranged to engage with an inner circumferential face of the electric contact portion.

* * * * *